US006328248B1

(12) United States Patent
Kaipf

(10) Patent No.: US 6,328,248 B1
(45) Date of Patent: Dec. 11, 2001

(54) WINDING MACHINE AND WINDING METHOD

(75) Inventor: Walter Kaipf, Haunsheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/419,296

(22) Filed: Oct. 15, 1999

(30) Foreign Application Priority Data

Oct. 22, 1998 (DE) ..... 198 48 814

(51) Int. Cl.[7] ..... B65H 19/22
(52) U.S. Cl. ..... 242/521; 242/526.1
(58) Field of Search ..... 242/521, 526.1, 242/525.4; 83/660, 678, 614, 56

(56) References Cited

U.S. PATENT DOCUMENTS

| | | | |
|---|---|---|---|
| 2,200,000 | 5/1940 | Johnstone et al. . | |
| 4,086,835 | 5/1978 | Frederick . | |
| 5,222,679 * | 6/1993 | Dropczynski et al. | 242/526.1 |
| 5,314,132 | 5/1994 | Ando et al. . | |
| 5,337,968 | 8/1994 | De Bin et al. . | |
| 5,735,481 | 4/1998 | Loosen . | |

FOREIGN PATENT DOCUMENTS

| | | |
|---|---|---|
| 2721883 | 11/1978 | (DE) . |
| 4010894 | 10/1991 | (DE) . |
| 4208746 | 5/1993 | (DE) . |
| 29508732 | 11/1995 | (DE) . |
| 19507800 | 9/1996 | (DE) . |
| 19653227 | 6/1998 | (DE) . |
| 19737709 | 11/1998 | (DE) . |
| 96/11868 | 4/1996 | (WO) . |
| 97/48632 | 12/1997 | (WO) . |
| 98/52858 | 11/1998 | (WO) . |

* cited by examiner

*Primary Examiner*—John M. Jillions
(74) *Attorney, Agent, or Firm*—Greenblum & Bernstein, P.L.C.

(57) ABSTRACT

A winding machine and method for winding a material web onto a reel-spool in which the material web is transported over a support roll and a winding nip is formed between the support roll and the reel-spool. For changing of reel-spool, the material web is weakened before the support roll in the web travel direction. The material web is then separated at the weakened point. The winding machine includes a rotatable perforating unit, the perforating unit provided with a plurality of one of cutting elements and perforating elements and a counter-holder is arranged on an opposite side of the web from the perforating unit, the perforating unit and the counter-holder are movable relative to one another to weaken the web. The winding method includes providing a rotatable perforating unit adjacent the web, the perforating unit being provided with a plurality of cutting elements providing a counter-holder positioned on an opposite side of the web from the perforating unit and mounting at least one of the perforating unit and the counter-holder so as to be movable relative to another to engage and weaken the web.

50 Claims, 3 Drawing Sheets

WINDING MACHINE AND WINDING METHOD

CROSS-REFERENCE TO RELATED APPLICATION

The present application claims priority under 35 U.S.C. §119 of German Patent Application No. 198 48 814.9, filed Oct. 22, 1998, the disclosure of which is expressly incorporated by reference herein in its entirety.

BACKGROUND OF THE INVENTION

1. Field of the Invention

The present invention relates to a winding machine and a method for winding a material web, such as a paper or cardboard web, onto a reel-spool. The material web is carried over a support roll, and a winding nip is formed between the support roll and the reel-spool. Whenever the reel-spool is to be changed, the material web is weakened by being perforated by a weakening device positioned before the support roll in the web travel direction. The material web is then separated at the weakened point.

2. Discussion of Background Information

A winding machine to which the present invention applies is used, for example, at the exit end of a machine for producing or finishing a material web. However, it can also serve, for example, for rewinding a roll that has already been wound onto a spool. The machine can be, for example, a paper machine. Separation of the material web can take place in the web travel direction after (i.e., downstream of the nip formed between the support roll and the new reel-spool. After the separation has taken place, the new leading edge of the material web is positioned about and attached to the new reel-spool.

A winding machine of this type is disclosed in DE-U 295 08 732. The weakening device disclosed therein includes a perforating comb that can swivel around a stationary axle, as well as a stationary counter-holder opposite the comb. During normal operation, the perforating comb must thus be swivelled away from the stationary counter-holder, whereas for each weakening of the material web, the comb must be swivelled around the stationary axle towards the counter-holder. However, such an arrangement is not suitable for higher operating speeds.

A perforating core is also used for each weakening of the material web in a winding machine disclosed in WO 96/11868. In this known winding machine, the perforating core is plunged into the material web perpendicular to the plane of the web.

SUMMARY OF THE INVENTION

The present invention relates to a winding machine for winding a material web onto a reel-spool in which the material web is transported over a support roll and a winding nip is formed between the support roll and the reel-spool. For changing of reel-spool, the material web is weakened before the support roll in the web travel direction. The material web is then separated at the weakened point. The winding machine includes a rotatable perforating unit, the perforating unit provided with a plurality of one of cutting elements and perforating elements and a counter-holder is arranged on an opposite side of the web from the perforating unit, the perforating unit and the counter-holder are movable relative to one another to weaken the web.

The cutting elements can be formed at least partially by one of needles and small knife-points and the counter-holder can extend transversely to the web travel direction and can extend substantially or at least essentially across the entire width of the winding machine.

The rotatable perforating unit can include at least one rotatable perforating roll carrying the elements.

The perforating roll can have a longitudinal axis that extends transverse to the web travel direction, the perforating roll being rotatable around said axis.

Additionally, the perforating roll can extend substantially or at least substantially across the entire width of the winding machine.

Further, the rotatable perforating roll can be controllable driven so that, before a change of reel-spool, the perforating roll rotates at a pre-settable rotation speed.

The pre-settable rotation speed of the perforating roll can be selected so that the circumferential speed of the perforating roll is at least substantially the same as a web speed.

Additionally, the perforating roll and the counter-holder are movable relative to one another such that, for each weakening of the material web, the cutting elements of the perforating roll, rotating at the pre-settable rotation speed, engage or plunge into the material web.

The cutting elements of the perforating unit can be arranged at least partially in a row that is oblique with respect to an axis of the perforating unit.

In the alternative, the cutting elements of the perforating unit can be arranged at least partially in an arrow-shaped row.

Moreover, the cutting elements of the perforating unit can be arranged at least partially in one of several adjacent arrow-shaped rows and zig-zags and the direction of the arrow-shaped rows can be parallel to the web travel direction.

Also, the cutting elements of the perforating unit can be arranged at least partially in a straight row running transversely to the web travel direction.

The perforating roll and the counter-holder can be movable relative to one another so that for each weakening of the material web, cutting elements are engaged with (plunged into) the material web during only one revolution of the perforating roll.

The counter-holder can extend transversely to the web travel direction and can have a plurality of recesses along the length of the counter-holder, the recesses being separated from one another by bridges extending in the web travel direction, with the cutting elements of the perforating unit extending into die recesses.

The counter-holder can include a mating roll extending transversely to the web travel direction and having a number of circumferential grooves distributed along the length of the mating roll, with the cutting elements of the perforating roll unit extending into the grooves.

The rotatable perforating unit can include at least one perforating wheel carrying the elements and the perforating wheel can be displacable along the material web transversely to the web travel direction.

The cutting elements of the perforating wheel can be arranged in a circumferential direction of the perforating wheel.

The cutting elements can be uniformly distributed over the circumference of the perforating wheel.

Further, a rotational axis of the perforating wheel can extend substantially in a plane parallel to a plane of the passing material web.

Moreover, a rotational axis of the perforating wheel can extend substantially parallel to the web travel direction.

On the other hand, a rotational axis of the perforating wheel can extend obliquely to the web travel direction.

The rotational axis of the perforating wheel can be set obliquely, so that when the perforating wheel has been moved over the running material web transversely to the web travel direction a substantially straight lengthwise cut is produced by each cutting element of the rotating perforating wheel.

The counter-holder can extend transverse to the web travel direction and can include a continuous groove that extends transverse to the web travel direction, the cutting elements of the perforating wheel extending into the groove.

The counter-holder can be swivelable towards the perforating unit or the perforating unit can be swivelable towards the counter-holder.

Separation of the material web can be at least assisted by blown air or separation of the material web can be at least assisted by a double-sided adhesive tape that is introduced into the winding gap.

The reel-spool can be provided with suction apertures to assist in the separation of the material web.

At each change of reel-spool, the new reel-spool can be positioned in a space between the support roll and the wound roll of web material on the old reel-spool.

Further, at each change of reel-spool, the new reel-spool can be arranged generally above the support roll.

The support roll can be mounted at a fixed position or the support roll can be a movable pressing roll.

The present invention also relates to a method for winding a material web onto a reel-spool in a winding machine wherein the web material is transported over a support roll and a winding nip is provided between the support roll and the reel-spool. For changing a reel-spool, the web material is weakened positioned upstream of the roll support, and the weakened web material is separated at a weakened point. The winding method includes providing a rotatable perforating unit adjacent the web, the perforating unit being provided with a plurality of cutting elements, providing a counter-holder positioned on an opposite side of the web from the perforating unit and mounting at least one of the perforating unit and the counter-holder so as to be movable relative to another to engage and weaken the web.

The provision of a rotatable perforating unit can include providing cutting elements in the form of needles on the rotatable perforating unit.

The provision of a counter-holder can include providing a counter-holder that extends substantially along the entire width of the winding machine.

The provision of a perforating unit can include providing a perforating roll having a longitudinal axis that extends transverse to the web travel direction and mounting the perforating roll for rotation about the longitudinal axis.

Further, a drive mechanism can be provided to drive the rotatable perforating roll to rotate at a pre-selected rotation speed during a change of reel-spool.

The presettable rotation speed of the roll can be selected so as to be substantially equal to a web material speed.

The provision of a rotatable perforating unit can include providing at least one perforating wheel which is displacable along the web material in a direction transverse to the web travel direction.

The provision of a perforating wheel can include providing cutting elements about a circumferential direction of the perforating wheel.

The provision of a perforating wheel can include positioning a rotational axis of the perforating wheel to lie substantially in a plane parallel to a plane of the web material.

The provision of a perforating wheel can include providing a rotational axis of the perforating wheel to extend obliquely to the web travel direction.

The provision of a counter-holder can include mounting the counter-holder to be swivelable towards and away from the perforating unit.

The provision of a perforating unit can include mounting the perforating unit to be swivelable towards and away from the counter-holder.

Further, air can be blown at the material web to assist in separation of the web material.

Additionally, suction apertures can be provided to the reel-spool to assist in separation of the web material.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

Figure 1:
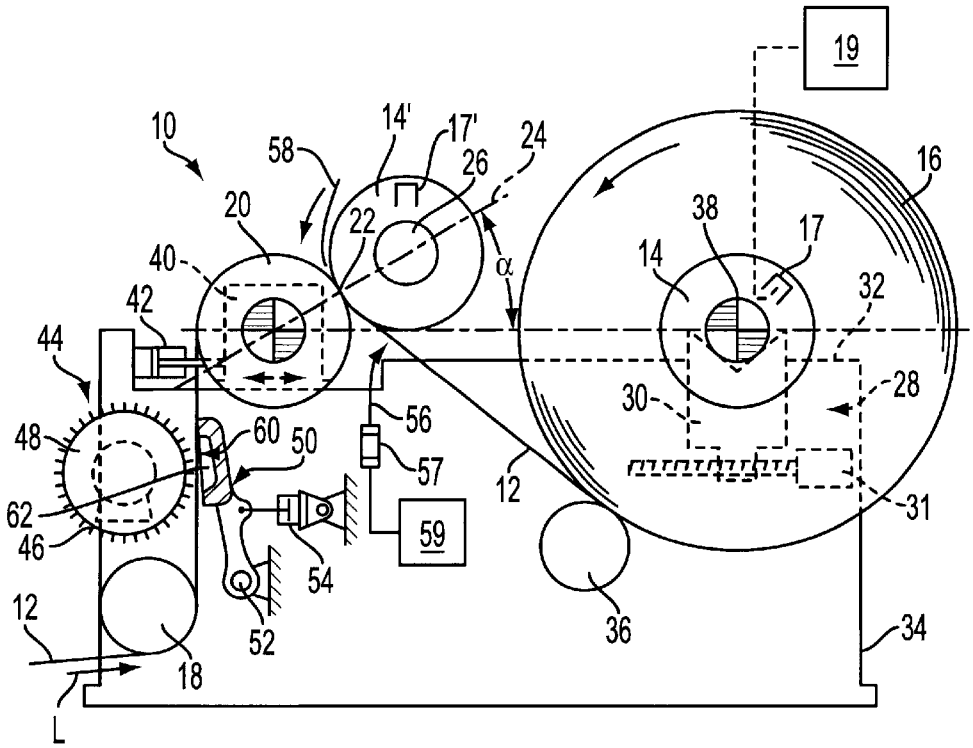
FIG. 1 shows a schematic representation of an embodiment of a winding machine with an associated perforating roll, according to the invention.

The present invention will be explained in more detail below based on examples making reference to the above-noted drawings.

DETAILED DESCRIPTION OF THE PRESENT INVENTION

According to the present invention a winding machine and winding method are provided for a web weakening device wherein the weakening device and method are also suitable for high speed operation.

According to the present invention, the weakening device includes a rotatable perforating unit provided with several cutting or perforating elements and a counter-holder arranged on the opposite side of the web. The perforating unit and the counter-holder can be moved relative to one another in order to cause weakening of the web.

Thus, the rotatable perforating unit can be accelerated to the desired rotational speed even before a change of reel-spool, so that it is possible to perform weakening of the material web with the required reliability and precision, even at higher web speeds. Particularly, after the desired speed of rotation has been reached, the rotatable perforating unit and the counter-holder can be moved relative to one another, whereupon the material web is perforated. The rotatable perforating unit can thus be accelerated to a speed of rotation such that the resulting circumferential speed of the perforating unit is at least substantially the same as the web speed.

The cutting elements can be formed at least partially by needles or small knife-points.

The counter-holder, which extends transversely to the web travel direction, preferably extends at least essentially or substantially across the entire width of the machine.

In an advantageous embodiment of the winding machine according to the present invention, the rotatable perforating unit includes at least one perforating roll. Such a perforating roll can extend transversely to the web travel direction, preferably at least substantially across the entire width of the machine.

In a preferred embodiment of the winding machine according to the present invention, the rotatable perforating roll can be driven and controlled so that, prior to a change of reel-spool, the perforating roll is accelerated to a pre-settable rotational speed. The pre-settable rotational speed of the perforating roll is preferably selected so that the resulting circumferential speed of the perforating roll is at least substantially the same as the material web speed.

Advantageously, the perforating roll, provided with the cutting elements, and the counter-holder can be moved relative to one another. Thus, for each weakening of the material web, the cutting elements of the perforating roll, rotating at the pre-settable rotational speed are engaged with (plunged into) the material web.

The cutting elements of the perforating roll can be arranged at least partially in a row that is oblique to the roll axis. In certain cases, it is also advantageous for the cutting elements to be arranged at least partially in an arrow-shaped row.

According to a further embodiment the cutting elements of the perforating roll are arranged at least partially in several adjacent arrow-shaped rows or in zig-zags. The respective direction of these arrows is preferably substantially parallel to the web travel direction.

However, the cutting elements of the perforating roll can also be arranged at least partially in a straight row running transversely to the web travel direction.

In a preferred embodiment, the perforating roll, provided with the cutting elements, and the counter-holder can be moved relative to one another such that, for each weakening of the material web, the cutting elements are plunged into the material web only during a single revolution of the perforating roll.

The counter-holder, extending transversely to the web travel direction, can have a number of recesses distributed along its length and separated from one another by bridges extending in the web travel direction. The cutting elements of the perforating roll extend into the recesses.

In an alternative embodiment of the winding machine according to the present invention, the counter-holder includes a mating roll extending transversely to the web travel direction and having a number of circumferential grooves distributed along its length, into which cutting elements of the perforating roll extend.

According to a further alternative embodiment of the winding machine according to the present invention, the rotatable perforating unit includes at least one perforating wheel. The at least one perforating wheel can preferably be displaced across the material web, transversely to the web travel direction.

The cutting elements of the perforating wheel can be arranged in a row extending in the circumferential direction of the wheel. It is preferable for the cutting elements to be distributed evenly over the circumference of the perforating wheel.

The rotational axis of the perforating wheel can lie substantially in a plane parallel to the plane of the passing material web.

In a preferred embodiment, the rotational axis of the perforating wheel extends essentially parallel to the web travel direction.

According to an alternative embodiment, the rotational axis can run obliquely to the web travel direction. In this case, the rotational axis is advantageously set obliquely so that, when the perforating wheel has been moved across (or over) the moving (orb) material web, transversely to the web travel direction, a substantially straight cut is produced by each cutting element of the rotating perforating wheel.

If a perforating wheel is used, the counter-holder extending transversely to the web travel direction preferably includes a continuous groove extending in the web travel direction, into which the cutting elements of the perforating wheel extend.

In a preferred embodiment, the counter-holder can swivel against the perforating unit. Alternatively or additionally, however, the perforating unit can also swivel against the counter-holder.

In one embodiment, the separation of the material web can be performed or assisted by blown air.

It is also advantageous if the separation of the material web is performed or assisted by a double-sided adhesive tape introduced into the winding nip.

In a further embodiment, the reel-spool can be provided with suction apertures in order to effect or assist the separation of the material web.

At each change of reel-spool, the new reel-spool can be positioned, for example, in a space between the support roll and the wound roll formed on the old reel-spool.

In principle, at such a change of reel-spool, the new reel-spool can also be arranged generally above the support roll. However, in this situation, a space can be provided between the support roll and the wound roll formed on the old reel-spool. However, the support roll can still lie against the previously formed wound roll during the reel-spool change.

The support roll can be seated in a stationary position or else can be designed as a movable pressing roll. In the latter case, the linear force in the winding nip is determined by a corresponding pressing device.

Other exemplary embodiments and advantages of the present invention may be ascertained by reviewing the present disclosure and the accompanying drawings.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken together with the drawings making apparent to those skilled in the art how the several forms of the present invention may be embodied in practice.

FIG. 1 shows, in a purely schematic representation, an exemplary embodiment of a winding machine 10 for winding a material web 12 onto a reel-spool 14, 14'. The material web 12 can be, for example, a paper or cardboard web. The winding machine can be provided, for example, at the end of a paper making or processing machine.

For producing a wound roll 16, the material web 12 is transported over a web guiding roll 18 and then over a support roll 20, which forms a winding nip 22 with an empty reel-spool 14'. In the alternative, the wound roll 16 can be formed of an already started (rather than empty) reel-spool 14. The support roll 20 and the wound roll 16 being formed are held in contact with one another during the winding procedure, in order to maintain this winding nip 22.

The next still empty reel-spool 14' is already being held in readiness at an orientation defined by 24 (i.e., primary bearing). This reel-spool 14'can be acted upon by a primary drive 26 by which it can be rotated at the orientation of the primary bearing 24. The primary drive 26 can be displaced along a first guide path defined by the primary bearing 24.

In addition, the winding machine 10 includes a secondary bearing 28 which can have a transport device 30 that can be displaced along a linear guide and has an associated drive 31, which in the present case is, for example, a spindle drive. Other appropriate drives can be utilized. Such a transport device 30 serves to hold and guide a reel-spool 14. Moreover, rails 32 can be provided, only one of which can be seen in FIG. 1. These rails 32 are arranged parallel to the horizontal direction and are fixed to a machine frame 34. Thus, a reel-spool 14 provided with axle journals can be positioned on the rails 32, so that the weight of the reel-spool 14 or the wound roll 16 being formed is carried by the rails 32.

In FIG. 1 a further roll 36 can be seen, by way of which the material web 12 that has already been transported is further pressed against the completed wound roll 16 past the support roll 20.

Thus, in the example shown, the wound roll 16 being formed can be displaced together with the associated reel-spool 14 along the second guide path parallel to the rails 32 that run essentially horizontally, by way of the transport device 30.

The reel-spool 14 can be acted upon by a secondary drive 38, which transmits a rotating motion to the reel-spool 14 within the secondary bearing 28. The secondary drive 38, which is provided as a center (i.e., axial) drive in the present case, can be displaced along the second guide path parallel to the rails 32, together with the reel-spool 14.

The support roll 20 which, for example, can also be driven by way of a center (i.e., axial) drive, serves in the present case as a pressing roll, such that it can be displaced, for example, via a guide block 40 parallel to the rails 32 of the secondary bearing 28. In the present case, the support roll 20 and the wound roll 16 with its associated reel-spool 14 are displaced in the same plane.

The linear force in the winding nip 22 can be adjusted as desired, particularly by way of appropriately pressing the support roll 20 against the reel-spool 14 or the wound roll 16 formed on the reel-spool 14. As can be seen from FIG. 1, a pressing device 42 acting upon the support roll 20 is provided for this purpose. A compensation for the increasing diameter of the wound roll 16 can be provided by way of, for example, providing a corresponding displacement of the wound roll 16 along the rails 32.

FIG. 1 shows the winding machine 10 in a phase of operation immediately before a change of reel-spool, for which the material web 12 must be separated.

For this purpose, the material web 12 is first weakened by being perforated by a weakening device 44 arranged before (i.e., upstream of) the support roll 20 in the web travel direction L, so that it can then be separated at the weakened point.

The weakening device 44 includes a rotatable perforating unit provided with several cutting or perforating elements 46 and embodied in the present example by a perforating roll 48, and a counter-holder 50 arranged on the opposite side of the web. In order to bring about a web weakening, the perforating roll 48 and the counter-holder 50 are mounted to be movable relative to one another.

Figure 2:
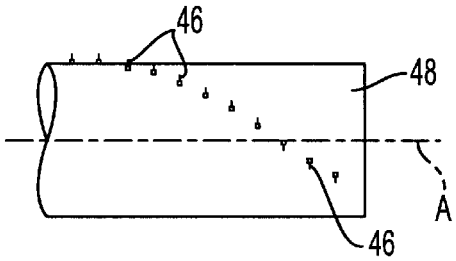
FIG. 2 shows a schematic top view of a part of a perforating roll having cutting elements arranged in an oblique row with respect to the axis of the roll.
Figure 3:
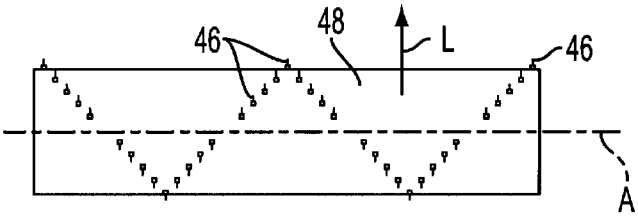
FIG. 3 shows a schematic top view of a perforating roll having cutting elements arranged in the shape of zig-zags.

The cutting elements 46 can be formed, for example, by needles or small knife-points, as is particularly shown in FIGS. 2 and 3.

The counter-holder 50 extends transversely to the web travel direction L substantially or at least essentially across the entire width of the machine. The same is also true of the perforating roll 48 that is rotatable around its axis. As a result, the perforating roll 48 and the counter-holder 50 are oriented parallel to one another transversely to the web travel direction L. The material web 12 is transported between the perforating roll 48 and the counter-holder 50 such that, in the present case, it assumes a substantially vertical path in the region of the weakening device 44.

In the present case, the rotatable perforating roll 48 can be driven and controlled so that before a change of reel-spool, the roll is rotating at a pre-settable rotational speed. In particular, the pre-settable rotational speed of the perforating roll 48 can be selected so that the resulting circumferential speed of the perforating roll 48 is substantially the same as the web speed.

In addition, the perforating roll 48, provided with the cutting elements 46, and the counter-holder 50 can be moved relative to one another such that, for each weakening of the material web 12, the cutting elements 46 of the perforating roll 48, rotating at the pre-settable speed of rotation are engaged with or plunged into the material web 12. By bringing the perforating roll 48 and the counter-holder 50 correspondingly closer and subsequently farther away from each other, it is also possible to ensure that, for each weakening of the material web 12, the cutting elements 46 are engaged with the material web 12 for only one revolution of the perforating roll 48.

In the present example, the counter-holder 50 can swivel and/or pivot against the perforating roll 48. The swivel axis 52 extends transversely to the web travel direction L. Each swiveling movement of the counter-holder 50 is effected by way of at least one activating device such as, for example, at least one cylinder/piston unit 54, which can be coupled, e.g., to the machine frame 34. Alternatively or in addition to the above, however, the perforating roll 48 can also swivel against the counter-holder 50. Further, instead of a cylinder/piston unit, an electromagnetic actuator such as a solenoid, or any other suitable actuating device, can be utilized.

In the present case, the separation of the material web 12 at the weakened point is performed by air 56 blown behind the winding gap 22 formed between the support roll 20 and the new reel-spool 14'. The blown air 56 can be provided by, for example, a row of nozzles, one of which is shown as 57, connected to an appropriate air supply 59.

The separation of the material web 12 can also be performed, or at least assisted, by a double-sided adhesive tape 58 from an appropriate source 47 (FIG. 4) introduced into the winding nip 22.

Further, the reel-spool 14, 14' can also be provided with suction apertures 17, 17' connected to an appropriate suction source 19 in order to effect or assist each separation procedure.

As can be seen from FIG. 1, at each change of reel-spool according to the present invention, the new reel-spool 14' is positioned in a space between the support roll 20 and the wound roll 16 formed on the old reel-spool 14.

FIGS. 2 and 3 show two examples of a possible arrangement of the cutting elements 46 on the perforating roll 48.

Thus, according to FIG. 2, the cutting elements 46 of the perforating roll 48 can be arranged, for example, in a row that is oblique with respect to the perforating roll axis A.

On the other hand, the cutting elements 46, in the example shown in FIG. 3 are provided on a jacket of the perforating roll 48 along a zig-zag line extending generally in the direction of the roll axis A. Such a zig-zag line can be formed, for example, by way of successive straight sections inclined at an angle of, for example, about 45° to the web travel direction L.

However, it is also possible, for example, to arrange the cutting elements 46 along a straight row extending transversely to the web travel direction L.

In the embodiment according to FIG. 1, the counter-holder 50, which extends transversely to the web travel direction L has a number of recesses 62 distributed along its length and separated from one another by bridges extending in the web travel direction L, into which the cutting elements 46 of the perforating roll 48 can extend (or plunge). In principle, however, the counter-holder 50 can, for example, also be formed by a mating roll extending transversely to the web travel direction L and having a number of circumferential grooves distributed along the length of the mating roll, into which the cutting elements 46 of the perforating roll 48 can extend.

Figure 4:
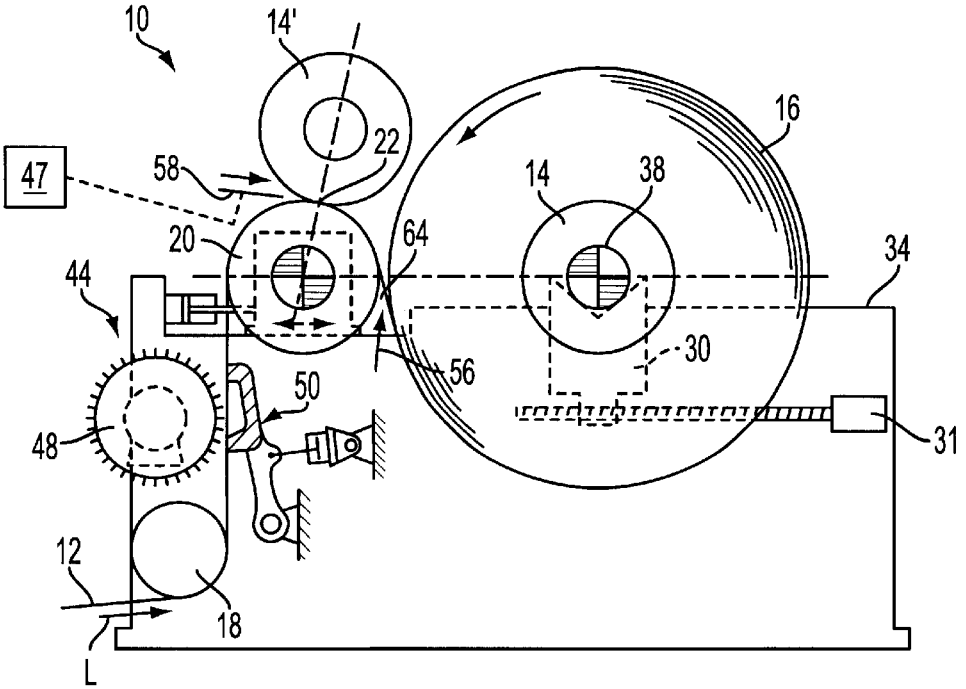
FIG. 4 shows a schematic representation of a further embodiment of a winding machine according to the present invention having an associated perforating roll.

FIG. 4 shows a further embodiment of a winding machine 10 having an associated perforating roll 48. This embodiment differs from that in FIG. 1 essentially in that, at each change of reel-spool, the new reel-spool 14' is arranged generally above, in the present case obliquely above, the support roll 20. The wound roll formed on the old reel-spool 14 is shown to be already somewhat displaced from the support roll 20, so that a small space 64 is present between the support roll 20 and the wound roll 16, in which area the weakened material web 12 is separated, for example, again by blown air 56. In principle, however, in this phase, before each change of reel-spool, the wound roll 16 can also still lie against the support roll 20, particularly when a double-sided adhesive tape 58 is introduced into the winding gap 22 for separating the material web 12 and securing the new leading edge to the new reel-spool 14'.

With regard to other features, this embodiment can have at least essentially the same construction as that of FIG. 1. The same reference numbers are thus assigned to corresponding parts. In both the embodiment according to FIG. 4 and the embodiment according to FIG. 1, after the material web 12 has been separated by the blown air 56, the initiation of winding onto the new reel-spool 14' is simultaneously assisted by the blown air.

Figure 5:
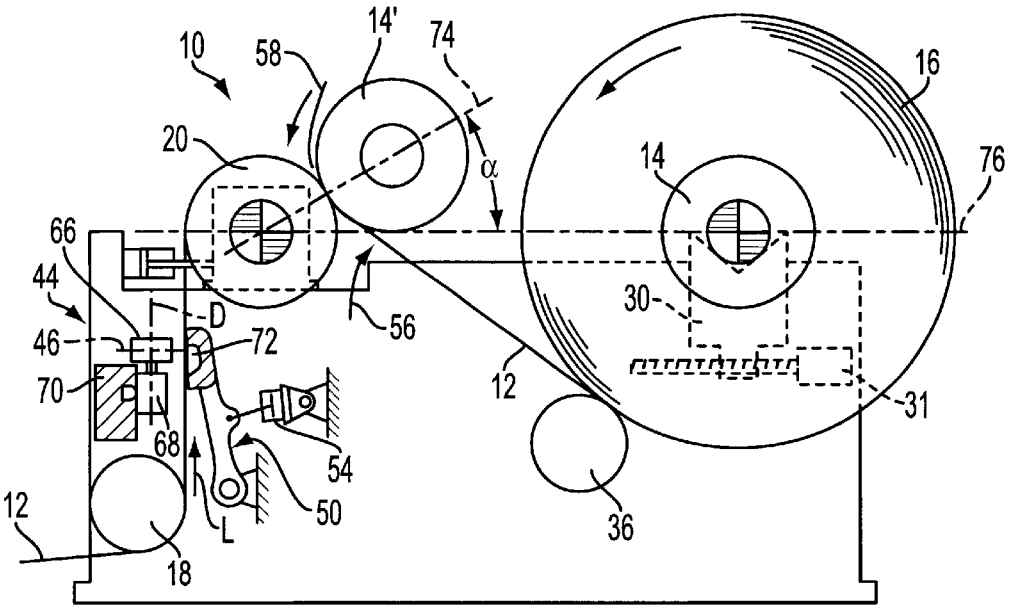
FIG. 5 shows a schematic representation of another embodiment of a winding machine according to the present invention having an associated perforating wheel.

FIG. 5 shows a Her embodiment of a winding machine 10 in which the weakening device 44 includes a perforating wheel 66 as a rotatable perforating unit, instead of a perforating roll.

This perforating wheel 66 can be displaced over the material web 12 transversely to the web travel direction L. The cutting elements 46 are distributed evenly over the external circumference of the perforating wheel 66 in a row extending in the circumferential direction. The rotational axis D of the perforating wheel 66 lies substantially in a plane parallel to the plane of the passing material web 12.

Moreover, in the embodiment of the present invention according to FIG. 5, the rotational axis D of the perforating wheel 66 runs substantially parallel to the running direction L of the material web 12 transported through the weakening device 44, i.e., in the present case, substantially vertically.

As can be seen from FIG. 5, the perforating wheel 66 is pivoted around the axis D in a support 68 that can be displaced transversely along the material web 12 on a support beam 70. The beam 70 can be anchored at both ends, for example, in the machine frame 34.

The counter-holder 50 likewise extends across the material web 12 transversely to the web travel direction L. The counter-holder 50 is provided with a continuous groove 72 extending transversely to the web travel direction L, into which the cutting elements 46 of the perforating wheel 66 plunge or extend as soon as the counter-holder 50 is swivelled against the perforating wheel 66 by way of at least one activating unit including, for example, at least one cylinder/piston unit 54.

In the FIG. 5 embodiment, as in the embodiment according to FIG. 1, the new reel-spool 14' is arranged, for each change of reel-spool, in a space between the support roll 20 and the wound roll 16 formed on the old reel-spool 14. In both cases, an acute angle a is thus defined between a straight line 74 running through the axes of the support roll 20 and the new reel-spool 14' and a straight line 76 running through the axes of the support roll 20 and the wound roll 16, which angle is in the range of about 30° in the examples shown. As to the other features, the embodiment according to FIG. 5 can also have substantially the same construction as the embodiment of FIG. 1. Again, the same reference numbers are assigned to parts corresponding to one another.

Figure 6:
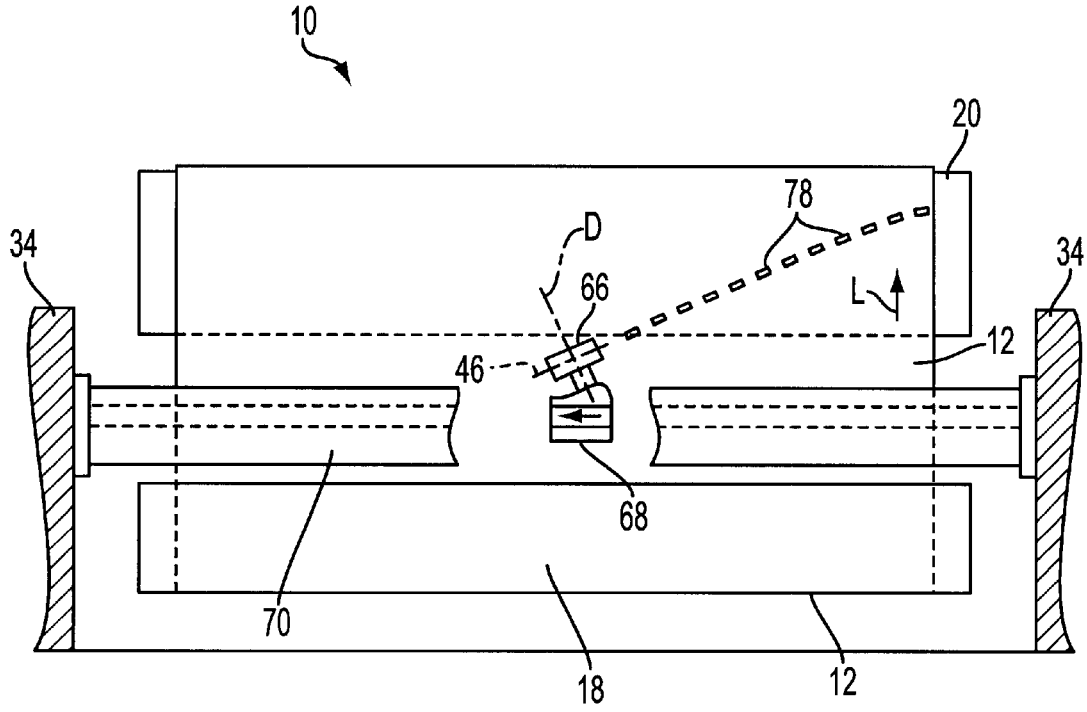
FIG. 6 shows a schematic front view of an additional embodiment of a winding machine according to the present invention having an associated perforating wheel.

FIG. 6 shows in a schematic front view a further embodiment of a winding machine 10 having an associated perforating wheel 66. This embodiment differs from that in FIG. 5 essentially in that the rotational axis D of the perforating wheel 66 does not extend along the web travel direction L, but extends obliquely to the web travel direction L. The rotational axis D can, in particular, be oriented obliquely in such a way tat, when the perforating wheel 66 has been moved across the running material web 12 transversely to the web travel direction L, a substantially straight longish cut 78 is produced by each cutting element 46 of the rotating perforating wheel 66 when, among other things, the speed of the web is taken into consideration.

The perforating wheel 66 is again pivoted around the axis D in a support 68, which can be displaced transversely across the material web 12 on a support beam 70. The beam 70 can be anchored at both ends in the machine frame 34. As for the other features, this embodiment can also have substantially the same construction as that of FIG. 5, whereby the same reference numbers are assigned to parts that correspond to one another.

The time during which the cutting elements 46 engage with the material web 12 to weaken it can be, for example, in the range of about ⅙ second.

The air jet produced by the blown air 56 can, for example, extend substantially across the entire width of the machine or, for example, can only be provided to strike the middle region of the material web 12.

Alternatively or in addition to the above, the reel-spool 14, 14' can also be provided with suction ports 17, 17' in the middle of the machine. Alternatively or in addition, an adhesive tape dispenser 47 can also be provided to dispense a tape to assist in separating the web material.

It is noted that the foregoing examples have been provided merely for the purpose of explanation and arc in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A winding machine for winding a material web onto a reel-spool in which the material web is transported over a support roll and a winding nip is formed between the support roll and the reel-spool and, for changing a reel-spool, the material web is weakened before the support roll, in the web travel direction, the material web then being separated at the weakened point, said winding machine comprising:

a rotatable perforating unit, said perforating unit provided with a plurality of one of cutting elements and perforating elements; and a counter-holder arranged on an opposite side of the web from the perforating unit, the perforating unit and the counter-holder being movable relative to one another to weaken the web, wherein each of the rotatable perforating unit and the counter-holder is movable towards and away from the web.

2. The winding machine according to claim 1, wherein the cutting elements are formed at least partially by one of needles and small knife-points.

3. The winding machine according to claim 1, wherein the counter-holder extends cross-wise to the web travel direction.

4. The winding machine according to claim 3, wherein the counter-holder extends substantially across the entire width of the winding machine.

5. The winding machine according to claim 1, wherein the rotatable perforating unit includes at least one rotatable perforating roll carrying said elements.

6. The winding machine according to claim 5, wherein the perforating roll has a longitudinal axis that extends transverse to the web travel direction, the perforating roll being rotatable around said longitudinal axis.

7. The winding machine according to claim 6, wherein the perforating roll extends substantially across the entire width of the winding machine.

8. The winding machine according to claim 5, wherein the rotatable perforating roll is controllable driven so that, before a change of reel-spool, the perforating roll rotates at a pre-settable rotation speed.

9. The winding machine according to claim 8, wherein the pre-settable rotation speed of the perforating roll is selected so that the circumferential speed of the perforating roll is at least substantially the same as a web speed.

10. The winding machine according to claim 8, wherein the perforating roll and the counter-holder are movable relative to one another such that, for each weakening of the material web, the cutting elements of the perforating roll, rotating at the pre-settable rotation speed, are engaged into the material web.

11. The winding machine according to claim 1, wherein the cutting elements of the perforating unit are arranged at least partially in a row that is oblique with respect to an axis of the perforating unit.

12. The winding machine according to claim 1, wherein the cutting elements of the perforating unit are arranged at least partially in an arrow-shaped row.

13. The winding machine according to claim 1, wherein the cutting elements of the perforating unit are arranged at least partially in one of several adjacent arrow-shaped rows and zig-zags.

14. The winding machine according to claim 12, wherein the direction of the arrow-shaped row is parallel to the web travel direction.

15. The winding machine according to claim 1, wherein the cutting elements of the perforating unit are arranged at least partially in a straight row running transversely to the web travel direction.

16. The winding machine according to claim 5, wherein the perforating roll and the counter-holder are movable relative to one another so that for each weakening of the material web, cutting elements extend into the material web during only one revolution of the perforating roll.

17. The winding machine according to claim 1, wherein the counter-holder extends transversely to the web travel direction and has a plurality of recesses along the length of the counter-holder, the recesses being separated from one another by bridges extending in the web travel direction, and the cutting elements of the perforating unit extending into the recesses.

18. The winding machine according to claim 1, wherein the counter-holder includes a mating roll extending transversely to the web travel direction and having a number of circumferential grooves distributed along the length of the mating roll, and the cutting elements of the perforating roll unit extend into the grooves.

19. The winding machine according to claim 1, wherein the rotatable perforating unit includes at least one perforating wheel carrying said elements.

20. The winding machine according to claim 19, wherein the perforating wheel is displacable along the material web transversely to the web travel direction.

21. The winding machine according to claim 19, wherein the cutting elements of the perforating wheel are arranged in a circumferential direction of the perforating wheel.

22. The winding machine according to claim 19, wherein the cutting elements are uniformly distributed over the circumference of the perforating wheel.

23. The winding machine according to claim 19, wherein a rotational axis of the perforating wheel lies substantially in a plane parallel to a plane of the passing material web.

24. The winding machine according to claim 19, wherein a rotational axis of the perforating wheel extends substantially parallel to the web travel direction.

25. The winding machine according to claim 19, wherein a rotational axis of the perforating wheel extends obliquely to the web travel direction.

26. The winding machine according to claim 25, wherein the rotational axis of the perforating wheel is positioned obliquely, so that when the perforating wheel has been moved over the running material web transverse to the web travel direction, a substantially straight lengthwise cut is produced by each cutting element of the rotating perforating wheel.

27. The winding machine according to claim 19, wherein the counter-holder extends transverse to the web travel direction and includes a continuous groove that extends transverse to the web travel direction, the cutting elements of the perforating wheel extending into the groove.

28. The winding machine according to claim 1, wherein the counter-holder is swivelable towards the perforating unit.

29. The winding machine according to claim 1, wherein the perforating unit is swivelable towards the counter-holder.

30. The winding machine according to claim 1, wherein separation of the material web is at least assisted by blown air.

31. The winding machine according to claim 1, wherein the separation of the material web is at least assisted by a double-sided adhesive tape that is introduced into the winding gap.

32. The winding machine according to claim 1, wherein the reel-spool is provided with suction apertures to assist in the separation of the material web.

33. The winding machine according to claim 1, wherein at each change of reel-spool, the new reel-spool is positioned in a space between the support roll and the roll of web material wound on the old reel-spool.

34. The winding machine according to claim 1, wherein at each change of reel-spool, the new reel-spool is arranged generally above the support roll.

35. The winding machine according to claim 1, wherein the support roll is mounted at a fixed position.

36. The winding machine according to claim 1, wherein the support roll comprises a movable pressing roll.

37. A method for winding a material web onto a reel-spool in a winding machine, wherein the web material is transported over a support roll and a winding nip is provided between the support roll and the reel-spool, and, for changing a reel-spool, the web material is weakened upstream of the roll support, and the weakened web material is separated at a weakened point, the method comprising:

providing a rotatable perforating unit adjacent the web, the perforating unit being provided with a plurality of cutting elements;

providing a counter-holder positioned on an opposite side of the web from the perforating unit; and mounting each of the perforating unit and the counter-holder so as to be movable relative to one another to engage and weaken the web, wherein each of the rotatable perforating unit and the counter-holder is movable towards and away from the web.

38. The winding method according to claim 37, wherein the provision of cutting elements comprises providing elements in the form of needles on the rotatable perforating unit.

39. The winding method according to claim 37, wherein the provision of a counter-holder comprises providing a counter-holder that extends substantially along the entire width of the winding machine.

40. The winding method according to claim 37, wherein the provision of a perforating unit comprises providing a perforating roll having a longitudinal axis that extends transverse to the web travel direction and mounting the perforating roll for rotation about the longitudinal axis.

41. The winding process according to claim 40, further comprising providing driving the rotatable perforating roll to rotate at a pre-selected rotation speed during a change of reel-spool.

42. The winding process according to claim 41, wherein the rotational speed is selected so as to be substantially equal to a web material speed.

43. The winding process according to claim 37, wherein the provision of a rotatable perforating unit includes providing at least one perforating wheel which is displacable along the web material in a direction transverse to the web travel direction.

44. The winding process according to claim 43, wherein the provision of a perforating wheel comprises providing cutting elements about a circumferential direction of the perforating wheel.

45. The winding process according to claim 43, wherein the provision of a perforating wheel comprises positioning a rotational axis of the perforating wheel to lie substantially in a plane parallel to a plane of the web material.

46. The winding process according to claim 43, wherein the provision of a perforating wheel comprises providing a rotational axis of the perforating wheel to extend obliquely to the web travel direction.

47. The method of winding according to claim 37, wherein the provision of a counter-holder comprises mounting the counter-holder to be swivelable towards and away from the perforating unit.

48. The method of winding according to claim 37, wherein the provision of a perforating unit comprises mounting the perforating unit to be swivelable towards and away from the counter-holder.

49. The method of winding according to claim 37, further comprising blowing air at the material web to assist in separation of the web material.

50. The winding method according to claim 37, further comprising providing suction apertures to the reel-spool to assist in separation of the web material.

* * * * *